US008631908B2

(12) United States Patent
Schroeder-Brumloop et al.

(10) Patent No.: US 8,631,908 B2
(45) Date of Patent: Jan. 21, 2014

(54) ELEVATOR SYSTEM AND ASSOCIATED METHOD INCLUDING POWER CONTROL FOR OPERATING AN ELEVATOR IN AN EMERGENCY MODE

(75) Inventors: Helmut Schroeder-Brumloop, Berlin (DE); Marvin Dehmlow, Berlin (DE); Ingo Engelhard, Berlin (DE); Andreas Tutat, Berlin (DE)

(73) Assignee: Otis Elevator Company, Farmington, CT (US)

( * ) Notice: Subject to any disclaimer, the term of this patent is extended or adjusted under 35 U.S.C. 154(b) by 267 days.

(21) Appl. No.: 13/055,729

(22) PCT Filed: Jul. 25, 2008

(86) PCT No.: PCT/EP2008/006138

§ 371 (c)(1),
(2), (4) Date: Jan. 25, 2011

(87) PCT Pub. No.: WO2010/009746

PCT Pub. Date: Jan. 28, 2010

(65) Prior Publication Data

US 2011/0120810 A1 May 26, 2011

(51) Int. Cl.
*B66B 1/06* (2006.01)

(52) U.S. Cl.
USPC ..... 187/290; 187/391

(58) Field of Classification Search
USPC ..... 187/247, 277, 290, 293, 296, 297, 187/391–393; 318/375, 376; 307/66, 68
See application file for complete search history.

(56) References Cited

U.S. PATENT DOCUMENTS

| | | | | |
|---|---|---|---|---|
| 4,548,299 | A | 10/1985 | Nomura | |
| 4,742,892 | A | 5/1988 | Iwata | |
| 5,058,710 | A * | 10/1991 | Iwasa | 187/290 |
| 5,083,634 | A | 1/1992 | Yonemoto | |
| 5,744,927 | A | 4/1998 | Hayashida | |
| 6,199,667 | B1 * | 3/2001 | Fischgold et al. | 187/295 |
| 6,315,081 | B1 * | 11/2001 | Yeo | 187/290 |

(Continued)

FOREIGN PATENT DOCUMENTS

| | | | |
|---|---|---|---|
| GB | 2121557 | A | 12/1983 |
| JP | 62068087 | A | 3/1987 |

(Continued)

OTHER PUBLICATIONS

International Search Report and Written Opinion of the International Searching Authority for International application No. PCT/EP2008/006138 mailed Apr. 9, 2009.

Search Report for Chinese Application No. 200880131316.7 dated Apr. 19, 2013.

*Primary Examiner* — Anthony Salata
(74) *Attorney, Agent, or Firm* — Carlson, Gaskey & Olds

(57) ABSTRACT

An elevator system and associated method includes power control for operating an elevator (2) in an emergency mode wherein the elevator (2) includes a car (4), a drive motor (10), a motor drive unit (26) which supplies power to the drive motor (10) and controls the same and an emergency power supply (42). The motor drive unit (10) has a predetermined normal operation switching frequency. In an emergency mode, power is supplied to the motor from the emergency power supply (42) while the motor drive unit is in an emergency mode. An actual emergency operation condition characteristic is determined for setting the switching frequency of the motor drive unit (46) dependent on the actual emergency operation condition characteristic.

26 Claims, 3 Drawing Sheets

(56) References Cited

U.S. PATENT DOCUMENTS

| | | | | |
|---|---|---|---|---|
| 6,732,838 | B1 * | 5/2004 | Okada et al. | 187/290 |
| 6,971,482 | B2 * | 12/2005 | Takeda | 187/313 |
| 7,540,355 | B2 * | 6/2009 | Harkonen | 187/290 |
| 7,837,011 | B2 * | 11/2010 | Takasaki et al. | 187/296 |
| 7,942,246 | B2 * | 5/2011 | Saarikoski et al. | 187/290 |
| 8,127,894 | B2 * | 3/2012 | Agirman et al. | 187/290 |
| 8,172,042 | B2 * | 5/2012 | Wesson et al. | 187/382 |
| 8,230,978 | B2 * | 7/2012 | Agirman et al. | 187/290 |

FOREIGN PATENT DOCUMENTS

| | | | |
|---|---|---|---|
| JP | 5178550 | A | 7/1993 |
| JP | 9002753 | A | 1/1997 |
| JP | H09110329 | A | 4/1997 |
| JP | H09121561 | A | 5/1997 |
| JP | 2001008459 | A | 1/2001 |
| JP | 2001114482 | A | 4/2001 |

* cited by examiner

ELEVATOR SYSTEM AND ASSOCIATED METHOD INCLUDING POWER CONTROL FOR OPERATING AN ELEVATOR IN AN EMERGENCY MODE

Elevators comprising a car, possibly also a counterweight, a drive motor, a motor drive unit which supplies power to the drive motor and controls the same and an emergency power supply are known and widely in use. In normal operation the motor drive unit is connected to the grid and receives power therefrom and supplies the power to the drive motor and thus controls the movement of the car in accordance with respective commands received from the elevator control. An elevator of this type is e.g. disclosed in WO 2005/040027 A1 of the applicant of the present application, which document is included herein as a whole by reference. PCT/EP 2005/000174 and PCT/EP 2005/000175 which have also been assigned to the applicant of the present application relate to is similar subject matter and are also enclosed herein as a whole by reference. As it is known from such prior art, it is possible to supply power from the emergency power supply to the motor drive unit in case of an emergency situation and to perform a rescue run, e.g. a run at reduced speed to the next available landing, with the power supply from the emergency power supply which typically comprises a re-chargeable battery. The re-chargeable battery of the emergency power supply is typically kept at maximum load condition in order to secure sufficient capacity for any emergency operation. Nevertheless, for the battery to be able to reliably drive the elevator car to the next available landing, a battery having a substantial capacity is required. However, batteries are relatively expensive so that it is desirable to have a battery which is as small as possible.

The conventional motor drive units have power switching semiconductors, like MOSFETs or IGBTs, which generate audible noises when operated with a switching frequency within the spectrum of audible noise. Accordingly, conventional motor drive units are operated with a switching frequency which is in a range so as to avoid annoying noise in the building and/or the elevator car. Accordingly, it would be beneficial to provide a method for operating an elevator in an emergency mode and a corresponding elevator which allow for the reduction of the battery size for the emergency power supply.

SUMMARY

Exemplary embodiments of the invention include a method for operating an elevator in an emergency mode wherein the elevator comprises a car, a drive motor, a motor drive unit which supplies power to the drive motor and controls the same, and an emergency power supply, wherein the motor drive unit has a predetermined normal operation switching frequency, comprising the following steps:

(a) supplying power from the emergency power supply;

(b) bringing the motor drive unit in an emergency mode;

(c) determining an actual emergency operation condition characteristic; and (d) setting the switching frequency of the motor drive unit dependent on the actual emergency operation condition characteristic.

Further exemplary embodiments of the invention include an elevator comprising a car, a drive motor, a motor drive unit, which is connected to the drive motor and which is adapted to supply power to the drive motor and to control the same, and an emergency power supply, wherein the motor drive unit has a predetermined normal operation switching frequency, and wherein the elevator is, in case of an emergency situation, adapted to (a) receive power from the emergency power supply;

(b) bring the motor drive unit in an emergency mode;

(c) determine an actual emergency operation condition characteristic; and (d) setting the switching frequency of the motor drive unit dependent on the actual emergency operation condition characteristic.

Embodiments of the invention are described in greater detail below with reference to the Figures, wherein:

BRIEF DESCRIPTION OF THE DRAWINGS

FIGS. 1 and 2 show similar embodiments. Corresponding reference numerals in the Figures refer to similar elements throughout the individual Figures.

DETAILED DESCRIPTION

Figure 1:
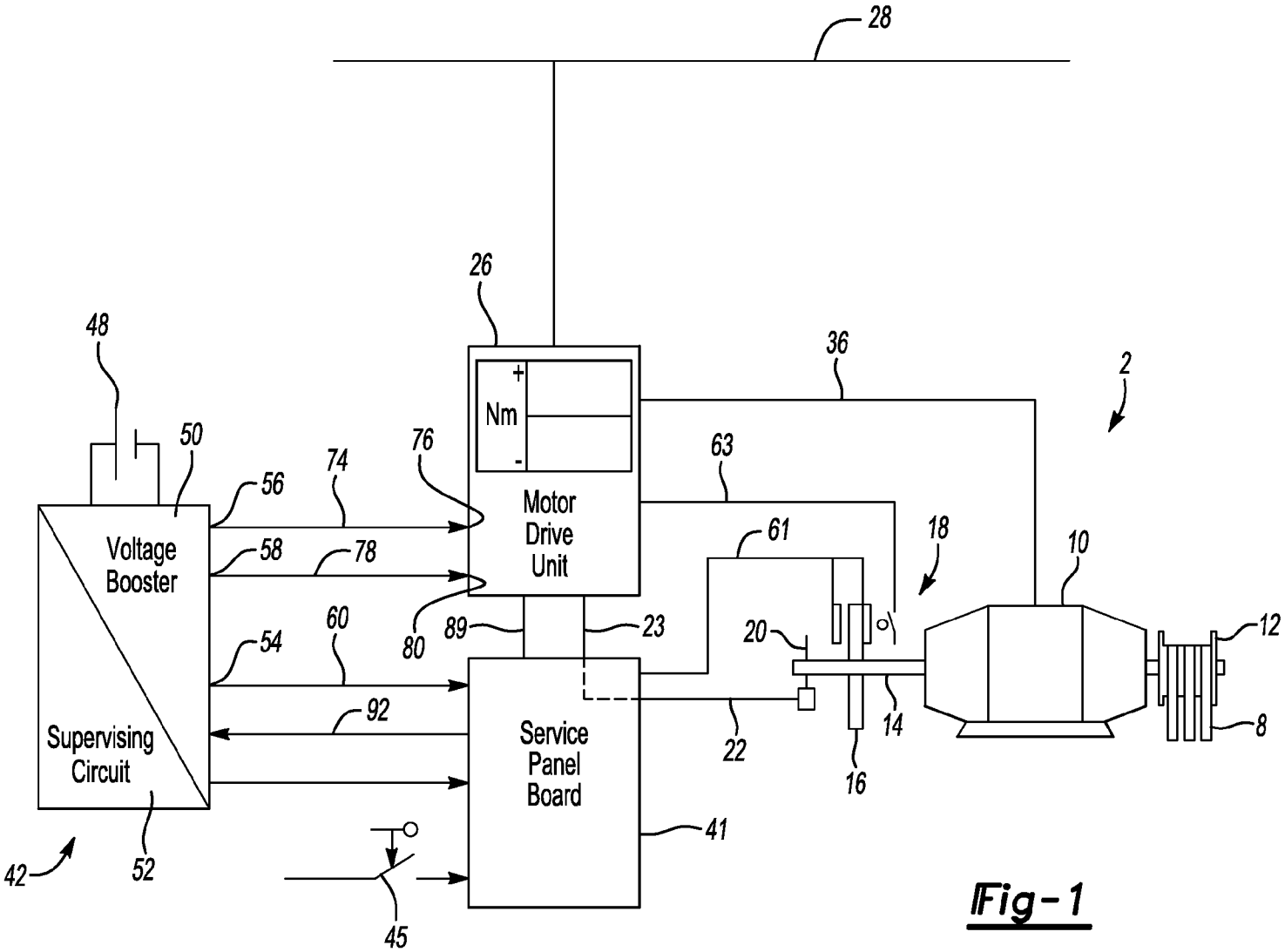
FIG. 1 is a schematic view of parts of the elevator in accordance with the first embodiment of the present invention.

FIG. 1 shows part of an elevator 2 comprising a hoisting rope 8 driven by a drive motor 10 via a traction sheave 12. The hoisting rope 8 can be either conventional ropes or coated steel belts, etc. Drive motor 10 drives the traction sheave 12 directly or via a gear. A brake disk 16 is provided in connection with the traction sheave 12 and is in the present embodiment attached to the shaft 14 of the drive motor 10. Brake disk 16 is part of brake 18.

Also attached to the shaft 14 of the drive motor 10 is an encoder wheel 20 providing encoder or speed control information via line 22 to a service panel board 41 and through the service panel board 41 to a motor drive unit 26. The motor drive unit 26 supplies the required power to the drive motor 10 through line 36. Motor drive unit 26 is connected to the grid 28 for receiving power therefrom during normal operation. Motor drive unit 26 can be of the type as will be described subsequently with respect to FIG. 2.

Instead of the encoder wheel 20, two encoding devices may be provided, one encoding device having high resolution for normal mode operation and the second one connected to the service panel board 41 for emergency mode operation.

The elevator 2 also comprises an emergency power supply 42. The emergency power supply 42 includes a re-chargeable storage battery 48 and a battery loading and supervising circuit 52. Emergency power supply 42 may further comprise a voltage booster 50 for supplying different output voltages. A voltage booster 50 may be necessary for supplying output voltages higher than the conventional voltage of the battery 48. With the present embodiment, the emergency power supply provides three different output voltages, i.e. a lower voltage to voltage output 54, a higher voltage to output 56, and an intermediate voltage to output 58. Depending on the particular elevator, the voltages may vary. However, typical voltage values are 24 Volt DC for lifting the brake 18 and supplying the electric control devices like speed control, etc., 110 Volt AC as this is the typical voltage used for the elevator safety chain, and 520 Volt DC for supplying the motor drive unit 26 and eventually the drive motor 10 (a typical voltage in the intermediate circuit 98, to be described below, is 400 Volt DC). The latter voltage depends on the particular construction of the motor drive unit 26. Typically, such a motor drive unit 26 requires a minimum input voltage even though the output voltage to the drive motor 10 will typically be far less in an emergency operating mode.

In FIG. 1, the lower voltage is supplied through line 60 to the service panel board 41 and can be distributed from the service panel board 41 to the brake 18 through line 61 connecting the service panel board 41 with brake 18. Alternatively, the lower voltage is supplied through line 60 to the motor drive unit 26, with line 63 connecting the motor drive unit with brake 18. In the latter case, the motor drive unit 26 can control the brake 18. It is possible to have only one of lines 61 and 63 instead of having both lines. Line 89 supplies low voltage from service panel board 41 to the motor drive unit 26 and/or communication information between service panel board 41 and the motor drive unit 26.

The motor drive unit 26 is preferably of the type capable of determining the movement condition of the elevator car, i.e. position, direction of movement, speed, and/or acceleration of the car on the basis of power information, i.e. the re-gained power from the motor 10, if the motor 10 operates in the generator mode, and/or the power is provided to motor 10 in active drive mode. It is to be noted, that exemplary power information are voltage, current, frequency, etc. The motor drive unit 26 can comprise a memory for storing power information so that if the car has been stopped in an emergency situation, relevant characteristics of the elevator 2 can be read from such memory. Alternatively, it is possible to sense the corresponding characteristics while operating the elevator 2 in an emergency mode. It is also possible to sense such power information in addition to the already stored information from the previous operation.

The motor drive unit 26 supplies timely varying power to drive motor 10 for controlling the speed thereof. Typically, the power will be supplied in the form of pulse width modulated electrical pulses. To this effect, the motor drive unit 26 comprises a control unit, e.g. a processor, which controls one or a plurality of electrical switches. These electrical switches are typically semiconductor devices like MOSFETs or IGBTs. Such devices have switching losses which are more or less proportionate to the number of switching actions per time unit. On the other hand, switching may also generate noise which is perceived by the users of the elevator people in the building as annoying. Accordingly, the motor drive unit 26 typically has a predetermined switching voltage which is set based on a trade-off between power losses and generated noise. With conventional motor drive units once set by design, such switching frequency will never be changed.

Figure 2:
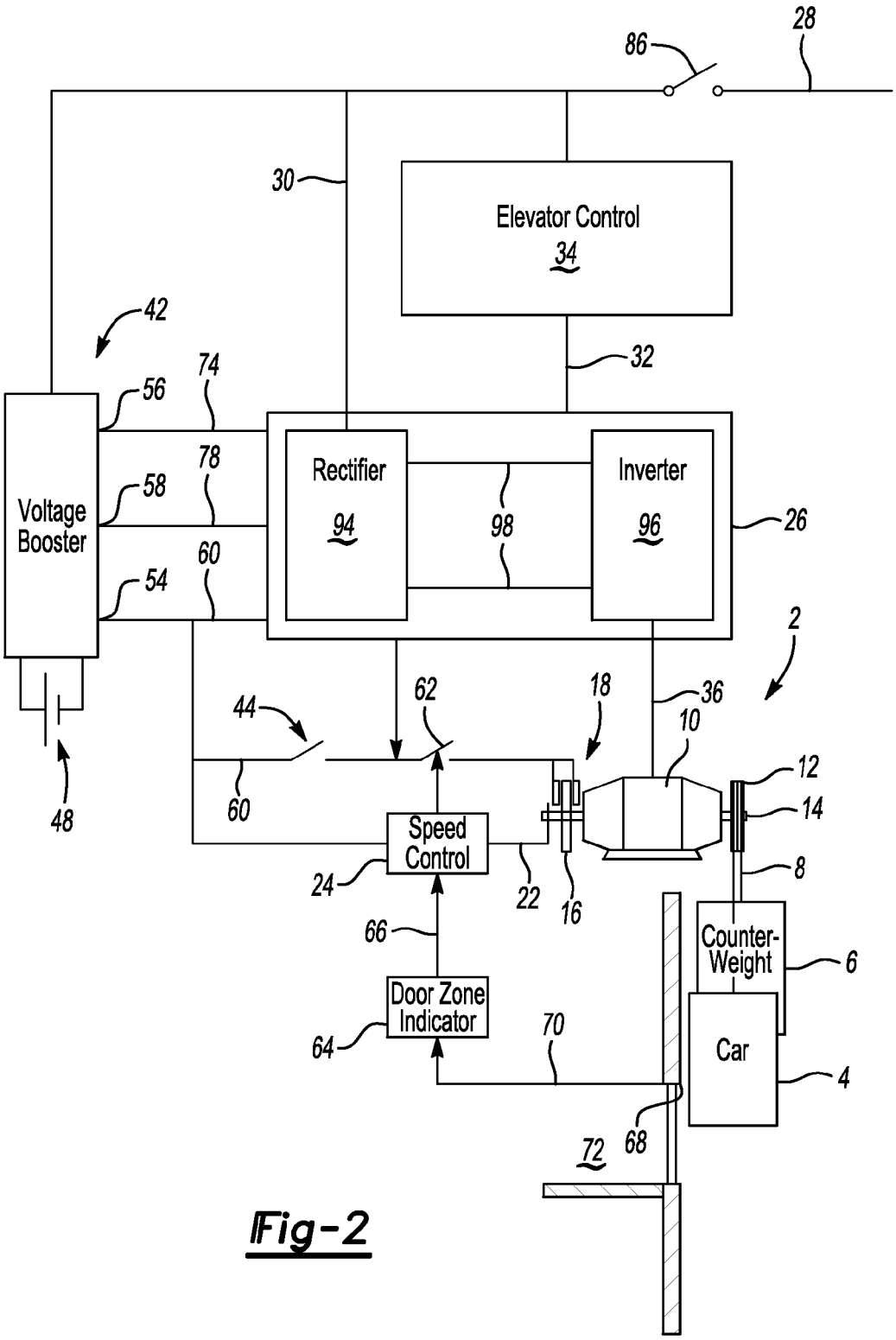
FIG. 2 is a schematic view of an elevator in accordance with a second embodiment of the present invention with more details.

The embodiment of FIG. 2 is generally similar to FIG. 1 and shows an elevator 2 comprising a car 4 and a counterweight 6. The car 4 and the counterweight 6 are suspended by the hoisting rope 8. The hoisting rope 8 is driven by the drive motor 10 via the traction sheave 12. Additionally to the embodiment of FIG. 1, a door zone indicator (DZI) 64 connected with a door zone sensor 68 via line 70 is shown. In the embodiment of FIG. 2, the door zone indicator 64 is connected to a separate speed control 24 via line 66. Alternatively or additionally, there may be provided a signal line directly from the door zone sensor 68 to the speed control 24. The door zone sensor 68 signals to the speed control 24, once the elevator car 4 approaches and reaches a landing 72. Accordingly, the speed control 24 can interrupt the power supply to the brake 18 in case of overspeed of the elevator car 4 or if the elevator car 4 has reached a landing. A similar door zone indicator and a speed control may likewise be present in the embodiment of FIG. 1.

Again, the motor drive unit 26 is connected with main power supply 28 of the elevator 2 through line 30 and receives control signals from through line 32. The elevator control 34 is connected to the conventional hall call buttons and cabin call buttons (not shown) and receives transportation requests therefrom. Actual operation condition information is additionally provided to the elevator control 34 which calculates based on such information the optimum journey sequence, etc. and provides corresponding control signals to the motor drive unit 26 for opera-ting the car 4 accordingly.

The motor drive unit 26 comprises a rectifier 94 and an inverter 96. The rectifier 94 and the inverter 96 are connected by means of a DC intermediate circuit 98. The rectifier 94 rectifies the AC current received through line 30 and supplies the resulting DC voltage to the DC intermediate circuit 98.

In the preferred embodiment the rectifier is a controlled rectifier or converter 94 which in contrast to a passive rectifier allows to feed back re-gained power to the grid 28. The inverter 96 may be a VVVF inverter (VVVF—variable voltage variable frequency) which varies voltage and frequency output for controlling the drive motor 12 in accordance with the control signals of the elevator control 34. Both the converter 94 and the inverter 96 comprise switching devices as already mentioned controlled by the respective control unit like microprocessor. Each one can have its own control unit, but it is also possible to provide a single control unit for both thereof. Similarly, the inverter 96 and converter 94 both may have different switching frequencies.

Elevator 2 typically further comprises a main power switch 86 which is located in the main power supply line 30. It serves for disconnecting the main power supply 28 from the elevator 2 before initiating an emergency drive mode operation in order to assure well defined operating conditions even if during emergency mode the main power supply will be re-established. The main power supply switch 86 may be connected—mechanically or electronically—with the respective means for initiating emergency operation.

In the embodiments of FIGS. 1 and 2, means for initiating the emergency operation are provided. As such, the embodiment of FIG. 1 comprises the service panel board 41 which is activated by means of a so called brake release button ("BRB") 45. Similarly, the embodiment of FIG. 2 comprises an emergency brake switch 44, which, when closed supplies emergency power through line 60 for brake 18 and lifts the same. Once the speed control 24 senses arrival of the car 4 at the desired landing 72 or an overspeed condition, it interrupts emergency power supply to brake 18 by means of speed control switch 62, in particular a semiconductor device, so that the brake will fall in and stop the car. Instead of providing such manually operated means, an automatic system can be provided for. The motor drive unit 26 can be adapted to perform this task.

Generally, in case of emergency, like power failure, component failure, etc., the elevator is shut off, power from the main power supply to the elevator 2 is interrupted. In such a condition, the automatic emergency drive control, like the drive unit 26, may detect an emergency condition. To this effect, the motor drive unit 26 (and the automatic emergency control, respectively) can receive power from the emergency power supply 42 or may comprise its own power buffer device, like a power storage capacitor, etc. It may subsequently poll the necessary components for their availability for performing the emergency operation and start the emergency operation once this poll has been successfully performed. From here, the automatic emergency control can be more or less identical to the manually initiated emergency operation.

An elevator 2 comprising a car 4 and a counterweight 6 can have different actual emergency operation condition characteristics depending on the load condition in the elevator car 4 stopped in an emergency: (i) car 4 and counterweight 6 can be in a balanced condition, i.e. it is necessary to actively move the car 4 and counterweight 6 to the desired landing 72; (ii) car 4 and counterweight 6 may be slightly off-balanced which requires to actively initiate the movement of the car and counterweight; (iii) car 4 and counterweight 6 are substantially off-balanced so that the car would continuously accelerate after lifting the brake unless controlled accordingly.

It is clear that in conditions (i) and (ii) power needs to be supplied from the emergency power supply 42 to the drive motor 10, while in condition (iii) the drive motor 10 acts as a generator and supplies power back to the motor drive unit 26. The present invention allows for efficiently supplying power to the drive motor 10 and/or handling the re-gained power from drive motor 10 by fitting the switching frequency of the motor drive unit, i.e. the converter 94 and/or the inverter 96, dependent on the actual emergency operation condition characteristic so that an optimized operation can be performed. To this effect, motor drive unit 26 determines an actual emergency operation condition characteristic, e.g. any of the above conditions (i), (ii) and (iii). Instead of distinguishing between these 3 conditions, the system may also distinguish between balanced and unbalanced condition or may distinguish between a higher number of conditions beyond the above 3 conditions.

This determination can be based on elevator information like elevator power information as stored during previous operation or actual information which can be derived e.g. by lifting the brake while holding car and counterweight in position by means of the drive motor and the motor drive unit 26. It is also possible to derive actual elevator conditions from both sources of the elevator 2 at the same instance.

Figure 3:
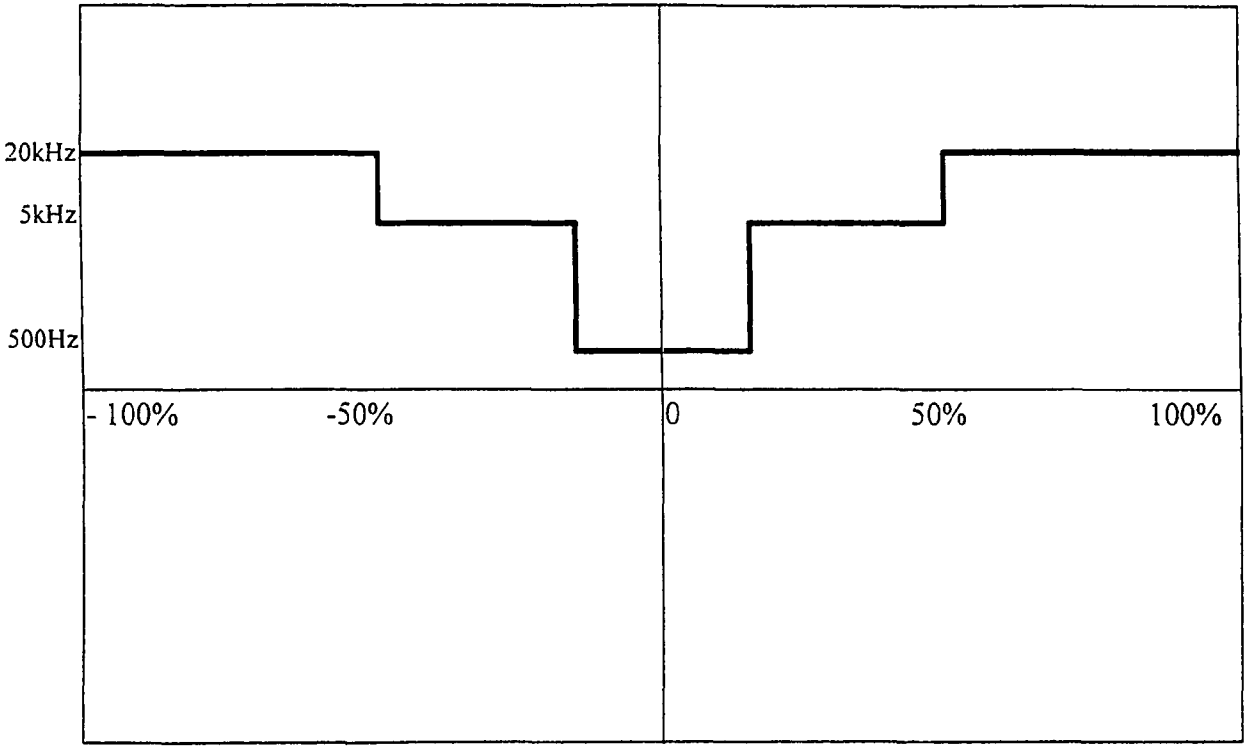
FIG. 3 is a diagram which shows different switching frequencies dependent on an actual emergency operation condition.

Based on this information the motor drive unit 26 can determine the optimum setting of the switching frequency of the motor drive unit 26. FIG. 3 shows a simple but efficient scheme for setting the switching frequency. Based on the off-balanced condition of car 4 and counterweight 6. On the horizontal axis of FIG. 3 a relative balanced/off-balanced state is shown with relative percentage values with 0% indicating the balanced condition, +100% indicating the complete off-balanced condition where the car is pulled upwardly in the shaft by the weight of the counterweight 6, and −100% indicating the complete off-balanced condition where the car 4 pulls the counterweight 6 upwardly in the shaft. On the vertical axis the switching frequency is exemplarily given with a normal switching frequency of 5 kHz.

In case of an emergency situation in balanced or nearly balanced condition, i.e. the above mentioned conditions (i) and (ii), the switching frequency of the motor drive unit 26 is substantially reduced, i.e. in the present example down to 500 Hz. This has the effect that the switching losses are substantially reduced so that active operation of the drive motor 10 powered by the emergency power supply 42 can be performed much more efficiently. In such an emergency operation condition the generation of noise due to the reduced switching frequency is acceptable. In case of a slightly more disbalanced condition, i.e. up to approximately 50%, the switching frequency is set to be more or less the conventional switching frequency, i.e. it will typically not be changed. The drive motor 10 will actively be driven in this operation range but generates no more power than the power which can be consumed in the elevator 2, in particular by the brake and/or electric/electronic equipment. Only beyond a certain off-balanced condition, i.e. beyond the 50% as shown in FIG. 3, the drive is motor generates an amount of power which needs to be dissipated by other means than the conventional consumers in the elevator 2. To this effect, the switching frequency is substantially increased, up to 20 kHz in the present example. By doing so, the switching losses increase accordingly, so that the motor drive unit 26 will act as a power consumer and dissipate the re-gained power.

As already mentioned, the off-balanced values and particularly the switching frequency values of FIG. 3 are typical values which are considered by the inventors at this stage as being practical. The upper limit of the switching frequency will be a trade off between the lifetime reduction of the switching devices in the motor drive unit 26 due to the increased thermal load in rescue operation and the amount of power to be dissipated on the other hand. Typically the upper limit of the switching frequency will be 2-5 times of the normal switching frequency. Generally, the increase of the switching frequency will result in an increased velocity of the car during emergency operation which is due to the fact that in emergency operation the elevator 2 has a maximum power consumption capability only and the drive motor unit 10 can be operated in generator emergency mode only with a speed which corresponds to a power output equal to maximum power consumption. Accordingly, the increase of the switching frequency will result in an increased emergency operation velocity and accordingly in reduced rescue time for trapped passengers. On the other hand, this feature also allows for eliminating or reducing the capacity of dynamic breaking resistors (DBRs) which are required in conventional non-regenerative elevators 2 for dissipating the regenerated power from the drive motor 10. It is to be noted, however, that the present invention is not restricted to regenerative elevators, while they are a preferred embodiment. It is also possible to use the advantages of the present invention with non-regenerative elevators, i.e. merely the reduction of the switching frequency below the normal switching frequency, for more efficiently driving the drive motor 16, etc.

It is preferred for the motor drive unit 26 (and the emergency mode control, respectively) to actively switch on all available consumers of the elevator 2 if needed for dissipating re-gained power.

While with respect to FIG. 3 a stepwise setting of the switching frequency has been disclosed, it is to be noted that a gradual change of the setting frequency is conceivable as well. E.g. for additionally reducing of the rescue time for trapped passengers, it can be possible to first substantially reduce the switching frequency even in a substantially off-balanced condition so as to support fast acceleration of the car 4 up to a certain speed somewhat below the emergency operation velocity and to stepwisely or gradually increase the switching frequency so as to set and maintain the desired rescue operation velocity.

It has been shown, that at least in its preferred embodiments, the present invention allows to minimize battery sizes, requires no additional circuitry, e.g. dynamic brake resistors, and allows for maximizing the rescue speed. This allows for a reduction of component costs and maintenance costs for the batteries which are regularly replaced during maintenance.

Exemplary embodiments of the invention as described above allow for selecting, particularly changing, the switching frequency of the motor drive unit during emergency operation. Thus, it will be possible to substantially reduce the switching frequency as the car is actively driven by the drive motor during emergency situation. This will substantially reduce the losses generated by the motor drive unit as the losses are proportional to switching operations of the semiconductor devices. Accordingly, the power consumption can be substantially reduced and the capacity of the battery can accordingly be reduced. While this increases the noise generated by the motor drive unit the noise is acceptable during emergency operation.

It is also possible to substantially increase the switching frequency of the motor drive unit in order to increase the losses. This is particularly advantageous in case of regenerative elevators which re-gain energy under certain operational conditions and feed back this energy to the main input during normal operation. During an emergency operation feeding back of the power to the grid is generally impossible. If this is the case, the problem arises as to how to dissipate the re-gained power from the drive motor. Since the battery of the emergency power supply is fully charged in such a condition, it is impossible to feed the re-gained power into this battery. On the other hand, switching on all of the consumers of the escalator, like illumination, etc. will typically not suffice to consume all re-gain power. A conventional way in the prior art was the use of additional circuitry, e.g. dynamic brake resistors (DBR), for dissipating these energies. The use of DBR circuits, however, substantially increases manufacturing costs. Accordingly, exemplary embodiments of the present invention allow to further reduce costs by providing regenerative elevators without any additional circuitry for power dissipation during emergency drive mode.

Nevertheless, it can be advantageous to switch on all available consumers during an emergency operation which requires dissipation of re-gained electrical power, i.e. as described above in accordance with the emergency operation condition characteristics. It is also to be noted that by increasing the dissipation of the re-gained electrical power during such an emergency operation, it may be possible to increase the speed of the elevator car during rescue operation and thus to reduce the time for freeing trapped passengers from the car.

In addition to situations which require the reduction or increase of the switching frequency, situations may exist which do not require any changing of the switching frequency, e.g. if the gravity acting on the car and/or counterweight is just sufficient to move the car with the conventional switching frequency setting and will not require to dissipate additional energy.

It might be preferred to change the switching frequency continuously in the course of the emergency operation in order to provide optimum power to the drive motor or to provide the optimum electrical power dissipation during the emergency operation. Thus, it is possible to accelerate the car at the beginning of an emergency run with an emergency operation characteristic where the car would—slowly—accelerate during gravity, and to use a reduced switching frequency for economically driving of the drive motor. After a certain time, or once the desired speed has been reached, the switching frequency of the motor drive unit can abruptly or gradually be changed so that finally the car travels at its desired emergency speed.

While the invention has been described with reference for exemplary embodiments, it will be understood by those skilled in the art that various changes may be made and equivalents may be substituted with elements thereof without departing from the scope of the invention. In addition, many modifications may be made to adapt a particular situation or material to the teachings of the invention without departing from the essential scope thereof. Therefore, it is intended that the invention be not limited to the particular embodiment disclosed, but that the invention will include all embodiments falling within the scope of the amended claims.

The invention claimed is:

1. Method for operating an elevator in an emergency mode wherein the elevator comprises a car, a drive motor, a motor drive unit which supplies power to the drive motor and controls the same and an emergency power supply, wherein the motor drive unit has a predetermined normal operation switching frequency, comprising the following steps:

(a) supplying power from the emergency power supply to cause the drive motor to actively move the car;

(b) placing the motor drive unit in an emergency mode;

(c) determining an actual emergency operation condition characteristic; and (d) setting the switching frequency of the motor drive unit dependent on the actual emergency operation condition characteristic.

2. Method according to claim 1, wherein the step of setting the switching frequency comprises changing the switching frequency of the motor drive unit as compared to the normal operation switching frequency.

3. Method according to claim 1, wherein the motor drive unit comprises an inverter and a converter and wherein the inverter has a predetermined normal operation switching frequency and wherein the switching frequency of the inverter is set.

4. Method according to claim 1, wherein the motor drive unit comprises an inverter and a converter and wherein the converter has a predetermined normal operation switching frequency and wherein the switching frequency of the converter is set.

5. Method according to claim 1, comprising stopping the car in response to an emergency in advance of step (a).

6. Method according to claim 1, comprising determining a parameter characteristic for the actual condition of the elevator and changing the switching frequency dependent on such parameter.

7. Method according to claim 6, wherein the parameter is the load condition of the car and a counterweight.

8. Method according to claim 6, wherein the parameter is the speed of the car.

9. Method according to claim 6, wherein the parameter is the electrical current through the inverter.

10. Method according to claim 6, comprising determining based on the parameter whether electrical power needs to be fed to the drive motor in order to move the car, and to lower the switching frequency as compared to normal operation switching frequency if electrical power needs to be fed to the drive motor in order to move the car.

11. Method for operating an elevator in an emergency mode wherein the elevator comprises a car, a drive motor, a motor drive unit which supplies power to the drive motor and controls the same and an emergency power supply, wherein the motor drive unit has a predetermined normal operation switching frequency, comprising the following steps:

supplying power from the emergency power supply;

bringing the motor drive unit in an emergency mode;

determining an actual emergency operation condition characteristic;

setting the switching frequency of the motor drive unit dependent on the actual emergency operation condition characteristic;

determining a parameter characteristic for the actual condition of the elevator and changing the switching frequency dependent on such parameter; and determining based on the parameter as to whether the car will move due to gravity, and to raise the switching frequency as compared to normal operation switching frequency if the car will move due to gravity.

12. Method according to claim 11, wherein the switching frequency will be raised only when the speed of the car exceeds a certain limit.

13. Method according to claim 11, wherein the switching frequency will be raised only to an extent which is necessary to dissipate the superfluous electrical power as regenerated by the drive motor.

14. Method according to claim 11, wherein the motor drive unit comprises a converter and an inverter, wherein the converter is connected to the AC power source for providing, in normal operation, DC power to the inverter, and wherein the inverter is connected to the drive motor;

wherein the drive motor and the motor drive unit are adapted to operate in normal operation to re-gain power when the drive motor is driven by gravity acting on the car and to feed the same back to the AC power source, wherein the method comprises the following step:

increasing, in the emergency mode the switching frequency as compared to the normal operation switching frequency, if gravity moves the car.

15. Elevator comprising a car, a drive motor, a motor drive unit, which is connected to the drive motor and which is adapted to supply power to the drive motor and to control the same, and an emergency power supply, wherein the motor drive unit has a predetermined normal operation switching frequency, and wherein the elevator is, in case of an emergency situation, adapted to (a) receive power from the emergency power supply to cause the drive motor to actively move the car;

(b) place the motor drive unit in an emergency mode;

(c) determine an actual emergency operation condition characteristic; and (d) setting the switching frequency of the motor drive unit dependent on the actual emergency operation condition characteristic.

16. Elevator according to claim 15, which is adapted to perform an emergency stop, in case of an emergency mode, before power is supplied from the emergency power supply.

17. Elevator according to claim 15, which, in case of an emergency mode, is adapted to derive a parameter indicating the actual condition of the elevator and to set the switching frequency dependent on such parameter.

18. Elevator according to claim 17, wherein the parameter is the load condition of the car and a counterweight.

19. Elevator according to claim 17, wherein the parameter is the speed of the car.

20. Elevator according to claim 17, wherein the parameter is the electrical power as generated by the drive motor.

21. Elevator according to claim 15, wherein the inverter has a predetermined normal operation switching frequency and wherein, in case of an emergency mode, the elevator is adapted to set the switching frequency of the inverter.

22. Elevator according to claim 15, wherein the converter has a predetermined normal operation switching frequency and wherein, in case of an emergency mode, the elevator is adapted to set the switching frequency of the converter.

23. An elevator system comprising a car, a drive motor, a motor drive unit, which is connected to the drive motor and which is adapted to supply power to the drive motor and to control the same, and an emergency power supply, wherein the motor drive unit has a predetermined normal operation switching frequency, and wherein the elevator is, in case of an emergency situation, adapted to (a) receive power from the emergency power supply;

(b) bring the motor drive unit in an emergency mode;

(c) determine an actual emergency operation condition characteristic; and (d) setting the switching frequency of the motor drive unit dependent on the actual emergency operation condition characteristic, wherein, in case of an emergency mode, the elevator is adapted to determine based on the parameter whether the car will move due to gravity or whether electrical power will have to be fed to the drive motor in order to move the car, and to raise the switching frequency as compared to normal operation switching frequency if the car will move due to gravity and to lower the switching frequency as compared to the normal operation switching frequency if electrical power needs to be fed to the drive motor in order to move the car, respectively.

24. Elevator according to claim 23, wherein the elevator is adapted to raise the switching frequency only when the speed of the car exceeds a certain limit.

25. Elevator according to claim 23, wherein the elevator is adapted to raise the switching frequency only to an extent which is necessary to dissipate the superfluous electrical power as regenerated by the drive motor.

26. Elevator according to claim 23, wherein the motor drive unit comprises a converter and an inverter, wherein the converter is connected to an AC power source, for providing, in normal operation, DC power to the inverter, and wherein the inverter is connected to the drive motor;

wherein the drive motor and the motor drive unit are adapted to re-gain energy when the drive motor is driven by gravity acting on the car and to feed the same back to the AC power source; and wherein the drive motor unit is adapted to increase, in the emergency mode the switching frequency as compared to the normal operation switching frequency, if gravity moves the car.

* * * * *